US005786670A

United States Patent [19]

Nguyen

[11] Patent Number: 5,786,670

[45] Date of Patent: Jul. 28, 1998

[54] HIGH-FREQUENCY CONVERTER FOR FLUORESCENT LAMPS USING AN IMPROVED TRIGGER CIRCUIT

[75] Inventor: Long Thanh Nguyen, El Paso, Tex.

[73] Assignee: Valmont Industries, Inc., Valley, Nebr.

[21] Appl. No.: 619,811

[22] Filed: Mar. 15, 1996

[51] Int. Cl.[6] ..... H05B 37/00

[52] U.S. Cl. ..... 315/200 R; 315/205; 315/219; 315/DIG. 5

[58] Field of Search ..... 315/209 R, 224, 315/291, 307, 308, DIG. 5, DIG. 7, 200 R, 201, 206, 205, 219; 362/21

[56] References Cited

U.S. PATENT DOCUMENTS

| | | | |
|---|---|---|---|
| 3,793,557 | 2/1974 | Cramer | 315/199 |
| 4,104,715 | 8/1978 | Lawson, Jr. | 363/37 |
| 4,469,988 | 9/1984 | Cronin | 315/209 |
| 4,503,361 | 3/1985 | Hanlet | 315/221 |
| 4,572,988 | 2/1986 | Handler et al. | 315/209 |
| 4,580,080 | 4/1986 | Smith | 315/199 |
| 4,782,268 | 11/1988 | Fahnrich et al. | 315/200 |
| 4,928,039 | 5/1990 | Nilssen | 315/209 |
| 4,987,347 | 1/1991 | Leskovec et al. | 315/209 |
| 5,030,887 | 7/1991 | Guisinger | 315/158 |
| 5,111,114 | 5/1992 | Wang | 315/225 |
| 5,349,515 | 9/1994 | Megeid | 363/21 |
| 5,378,964 | 1/1995 | Kang | 315/247 |

*Primary Examiner*—Robert J. Pascal
*Assistant Examiner*—David H. Vu
*Attorney, Agent, or Firm*—Zarley, McKee, Thomte, Voorhees, & Sease

[57] ABSTRACT

A high frequency converter for driving a gas discharge lamp load is comprised of an input stage for receiving an AC input voltage and rectifying the input voltage to create a DC voltage source, an oscillating power inverter, an output stage connected to the power inverter, and a trigger circuit used to initiate oscillations in the power inverter. The trigger circuit further comprises a voltage ramp circuit. The output stage includes a transformer having a center tap and two capacitors of equal value connected from the tap to each end of the transformer. The capacitors and transformer form two resonant tanks. Also, an RF choke may be connected between the center tap and the source of DC voltage.

20 Claims, 1 Drawing Sheet

HIGH-FREQUENCY CONVERTER FOR FLUORESCENT LAMPS USING AN IMPROVED TRIGGER CIRCUIT

BACKGROUND OF THE INVENTION

1. Field of the Invention

The present invention relates to circuits for driving gas discharge lighting circuits. More particularly, though not exclusively, the present invention relates to a high frequency converter for fluorescent lamps.

2. Problems in the Art

In a typical prior art circuit for driving a gas discharge lamp load, the lamp load is driven by an AC voltage supply via a rectifier and high frequency power inverter. The load is coupled to the inverter by a transformer. One goal in designing an electronic ballast circuit is to optimize the power line input performance, namely the total harmonic distortion (THD) and the power factor (PF). Other goals are to maximize the efficiency and minimize the cost & complexity of the ballast. Also, many prior art circuits operate at a high temperature and require a heat dissipating means such as asphalt poured into the ballast. As a result, ballast designs that increase the performance and reduce undesirable effects are desirable.

Some prior art ballasts include an output transformer with a center tap connected to a source of DC voltage and a single capacitor connected across the transformer. Such designs can produce undesirable results including running at high temperature and having high voltage spikes.

Prior art circuits typically use some sort of start-up circuit to initiate the oscillation of the high frequency inverter. However, these prior art start up circuits have been found to be unsatisfactory and inflexible.

OBJECTS OF THE INVENTION

A general object of the present invention is the provision of a high frequency converter for fluorescent lamps.

A further object of the present invention is the provision of a high frequency converter having a trigger circuit to initiate oscillations in the high frequency converter.

A further object of the present invention is the provision of a high frequency converter having a ramp generator for a trigger circuit.

A further object of the present invention is the provision of a high frequency converter for fluorescent lamps including a transformer having a center tap forming two resonant tanks.

A further object of the present invention is the provision of a high frequency converter for fluorescent lamps having two resonant tanks each including a capacitor connected in parallel to a transformer.

A further object of the present invention is the provision of a high frequency converter for fluorescent lamps having a transformer with a center tap and two capacitors having equal values, each in parallel to half of the transformer.

A further object of the present invention is the provision of a high frequency converter for fluorescent lamps having an RF choke connected between the source of DC voltage and the transformer tap.

A further object of the present invention is the provision of a high frequency converter for fluorescent lamps that operates at a low temperature.

These as well as other objects of the present invention will be come apparent from the following specification and claims.

SUMMARY OF THE INVENTION

A high frequency converter for driving a gas discharge lamp load includes an input stage for receiving an AC input voltage and creating a DC voltage source, a power inverter connected to the DC power source, an output stage connected to the power inverter, and a trigger circuit to initiate oscillations in the power inverter. The trigger circuit is comprised of a voltage ramp circuit.

The circuit may also be comprised of an input stage, a power inverter, and an output transformer having a tap and first and second shunts connected in parallel to the portions of the transformer on each side of the tap. Preferably, the tap is a center tap and the shunts are comprised of capacitors having equal values.

BRIEF DESCRIPTION OF THE DRAWINGS

FIGURE is a schematic diagram of the present invention.

DETAILED DESCRIPTION OF THE PREFERRED EMBODIMENT

Figure 1:
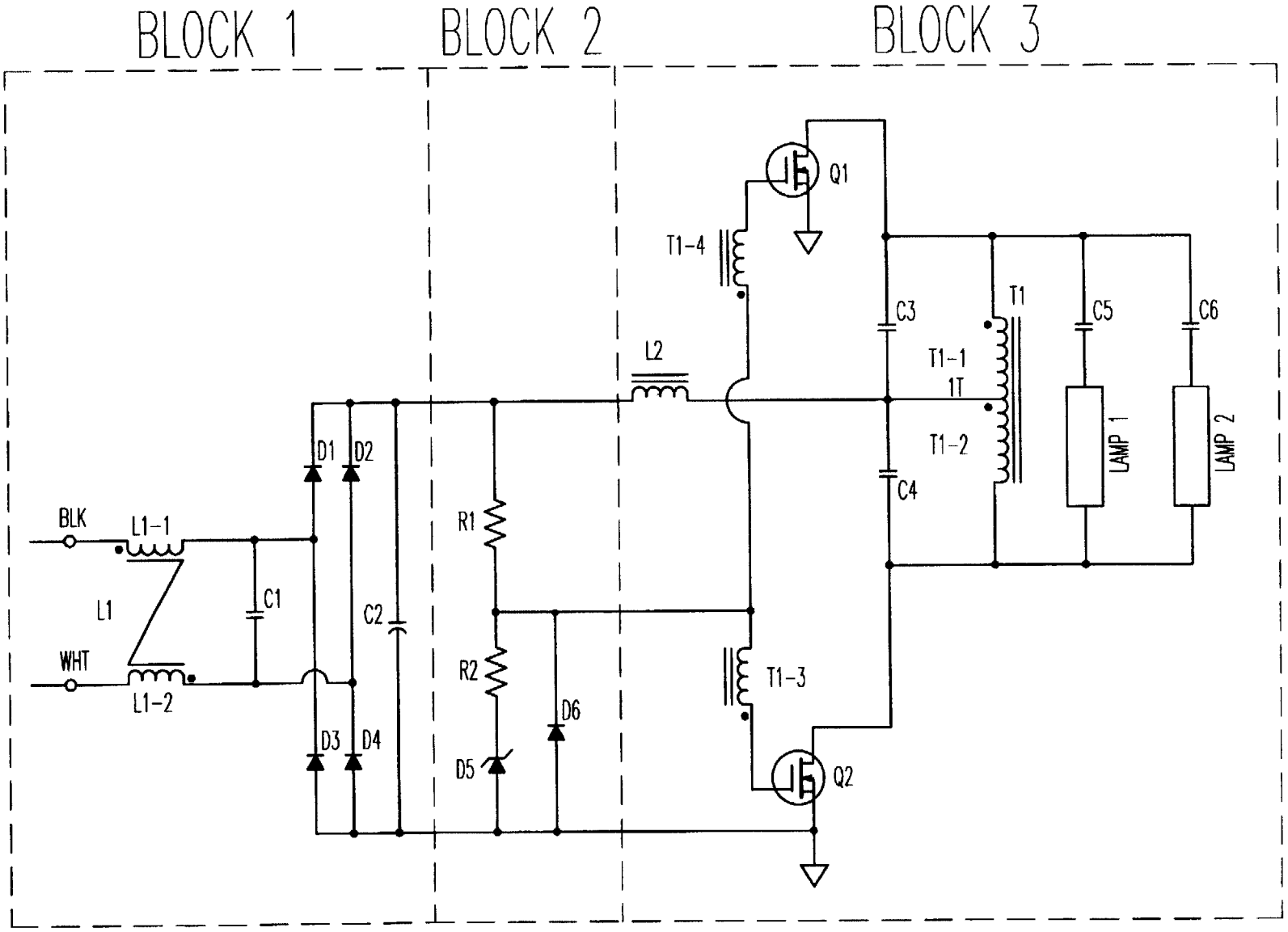

The present invention will be described as it applies to its preferred embodiment. It is not intended that the present invention be limited to the described embodiment. It is intended that the invention cover all alternatives, modifications, and equivalences which may be included within the spirit and scope of the invention.

FIG. 1 shows one embodiment of an electronic ballast of the present invention. Block 1 is the input stage of the ballast and includes an EMI and transient protection filter. The input stage provides filtering necessary to meet various requirements regarding conducted emissions and input transient requirements. Block 1 also includes a full wave voltage rectifier. Block 2 is connected to Block 1 and functions as a trigger circuit. The trigger circuit in Block 2 is connected to Block 3 which includes a DC to AC high frequency power inverter and an output stage of the ballast.

Block 1 of FIG. 1 shows the input stage of the electronic ballast. An AC input line voltage is provided at connections BLK and WHT. The AC input line connections BLK and WHT are connected to a passive power factor correcting circuit comprised of an isolation transformer L1 and capacitor C1. Isolation transformer L1 is comprised of two coils L1-1 and L1-2. The coils L1-1 and L1-2 are each connected to one of the lines BLK or WHT. A capacitor C1 is connected across coils L1-1 and L1-2 as shown in FIG. 1. Isolation transformer L1 and capacitor C1 form a second order low pass filter which is used to suppress all the current harmonics greater than the fundamental harmonic and third harmonic. This makes the third harmonic the only component contributing to the total harmonic distortion. The filter helps to prevent possible radiation of radio frequency interference from the instrument via the power line as well as filtering out incoming interference that may be present on the power line.

The power factor correcting circuit is connected to a full wave bridge rectifier comprised of diodes D1–D4. The voltage rectifier receives an AC voltage from the power factor correcting circuit and converts the voltage to a DC voltage and applies it across an electrolytic capacitor C2 to create a smooth DC voltage for use by the present invention. The rectifier shown in FIG. 1 is connected to a trigger circuit (Block 2) and a current fed self-oscillating inverter (Block 3).

An RF choke L2 is connected between the power inverter and the rectifier. The purpose of the RF choke is to convert the DC voltage into a DC current source which is fed into tap 1T and the junction of capacitors C3 and C4. The RF choke L2 is also used to choke all AC currents flowing through choke L2. The current fed self-oscillating inverter is powered by the DC current flowing through choke L2.

The current fed self-oscillating inverter of Block 3 is comprised of the RF choke L2, a resonant center tapped transformer T1, two resonant capacitors C3 and C4 and two MOSFET switches Q1 and Q2. The transistors Q1 and Q2 are driven at their base terminals by the voltages developed across the secondary windings (coils T1-4 and T1-3) of transformer T1. The oscillations of the inverter are initiated by the trigger circuit discussed below.

Block 2 includes a trigger circuit comprised of resistors R1, R2, zener diode D5 and diode D6. These components form a voltage ramp which is used to initiate oscillations in the oscillating inverter by turning on one of the two MOSFET switches Q1 and Q2. The trigger circuit shown in Block 2 allows the user to control trigger voltage used to start the inverter. This allows the present invention to be flexible and to operate effectively. The voltage of the trigger signal is controlled by controlling the ratio of power between resistors R1, R2 and diode D5. The characteristics of the trigger circuit depend primarily on the zener resistance in zener diode D5. As a result, the values of resistors R1 and R2 will be defined accordingly. For example, if a high wattage zener diode is used (e.g., 2 Watts), the zener resistance will be lower, and resistor R2 must be adjusted accordingly in order to get the desired trigger signal. Conversely, if a low wattage zener diode is used (e.g., 200 mW, 500 mW, or 1 W), the zener resistance will be higher, and resistor R2 must be adjusted to a lower value in order to get the desired trigger signal. As a result, by having resistor R2 in series with diode D5, the user will have full control of the adjustment of the trigger signal. Without resistor R2 in series with diode D5, it would be very difficult to get the desired trigger signal voltage.

To initiate oscillations in the power inverter, the trigger signal is provided to the power inverter circuit as shown in Block 3. Initially, the power inverter needs a high pulse to turn on transistor Q2. The trigger signal coming from the voltage divider comprising resistors R1 and R2 and diode D5 will cause transistor Q2 to turn on. Since windings T1-3 and T1-4 are wound on the same core as transformer T1, a current through transformer T1 in this direction causes winding T1-3 to maintain transistor Q2 on and causes winding T1-4 to maintain transistor Q1 off. When transistor Q2 is on, dc current will flow through inductor L2, through the center tap 1T, through transformer T1-2 and capacitor C4, and through transistor Q2 back to the source (capacitor C2). When C4 is fully charged, the voltages on all four windings of T1 reverse polarity, causing winding T1-4 to turn transistor Q1 on and causing winding T1-3 to turn transistor Q2 off. The circuit will continue to oscillate in this manner and deliver power to lamp 1 and lamp 2.

The oscillation of the power inverter continues by the nature of the resonant tanks consisting of capacitors C3 and C4 and the total inductance of windings T1-1 and T1-2 of transformer T1. Each resonant capacitor C3 and C4 is shunted from one end of transformer T1 to its center tap 1T. Capacitors C3 and C4 and transformer T1 form two resonant tanks, one comprised of capacitor C3 and winding T1-1, the other comprised of capacitor C4 and winding T1-2. Preferably, the two resonant tanks are identical, with the capacitances of capacitors C3 and C4 being equal and the inductances of windings T1-1 and T1-2 being equal. This configuration also speeds up the charging of the resonant tanks.

The design shown in FIG. 1 gives the user freedom to select the capacitors C3 and C4. Since capacitors typically come in certain discrete values and ratings, sometimes it is difficult to select a high voltage capacitor having the characteristics desired. For example, it may be hard to find a 2000 volt AC capacitor for a high frequency application. By using two capacitors in series such as shown in FIG. 1, the rating is cut in half, so that two 1000 volt AC capacitors could be used. Another result of the configuration shown in FIG. 1 is that the circuit will operate at a cooler temperature, allowing the user to remove any heat dissipating means found in the prior art such as asphalt poured in the ballast.

Another advantage to the configuration shown in FIG. 1 is that there is a stray capacitance between the collector and emitter of transistors Q1 and Q2. Without the center tap 1T and the capacitors C3 and C4, there would be a high voltage spike across the transformer T1. By tying capacitors C3 and C4 at the center tap 1T, there is a capacitive path from RF choke L2 to ground (through the emitters of transistors Q1 and Q2). As a result, any voltage spike or current spike will be suppressed through capacitors C3 and C4 and the stray capacitances of transistors Q1 and Q2.

The output stage of the present invention is comprised of two ballasting capacitors C5 and C6. Each of the capacitors C5 and C6 is connected in series with lamp 1 or lamp 2. The two series combinations of lamps and capacitors are connected in parallel to transformer T1. The ends of capacitors C5 and C6 which are connected to the transformer T1 are also connected to capacitor C3 and the drain of switch Q1. The ends of the lamps 1 and 2 which are connected to transformer T1 are also connected to the drain of switch Q2 and capacitor C4.

Table 1 lists the values for the components of the preferred embodiment. While these are the preferred values of the components, it will be understood that the invention is not limited to these values.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

TABLE 1

| ITEM | DESCRIPTION | VALUE or PART NUMBER |
|---|---|---|
| R1 | Resistor | 68 KΩ, 5%, 1/2W, CF |
| R2 | Resistor | 82 Ω, 5%, 1/4W, CF |
| C1 | Capacitor | .47 μF, 250 V, 5%, MEF |
| C2 | Capacitor | 33 μF, 250 V, 20%, ELECTROLYTIC |
| C3 | Capacitor | 2.2 nF, 630 V, MPP, 5% |
| C4 | Capacitor | 2.2 nF, 630 V, MPP, 5% |
| C5 | Capacitor | 1 nF, 1000 V, MPP, 5% |
| C6 | Capacitor | 1 nF, 1000 V, MPP, 5% |
| D1 | Diode | 1N4007 |
| D2 | Diode | 1N4007 |
| D3 | Diode | 1N4007 |
| D4 | Diode | 1N4007 |
| D5 | Diode | 3.9 Vz, 500 mW, 5%, Zener |
| D6 | Diode | 1N4007 |
| Q1 | Transistor | P3NA60, FET |
| Q2 | Transistor | P3NA60, FET |
| L2 | RF Choke | 10 mH |

What is claimed is:

1. A circuit for driving a gas discharge lamp load comprising:

an input stage for receiving an AC input voltage from an AC voltage source and rectifying the input voltage to create a DC voltage source;

an oscillating power inverter connected to said DC voltage source;

a trigger circuit connected across the DC voltage source and connected to said power inverter to initiate oscillations in said power inverter, wherein said trigger circuit is comprised of a voltage ramp circuit;

said voltage ramp circuit further comprises a zener diode connected in series with first and second resistors with the second resistor being connected in series between the first resistor and the zener diode, wherein the zenor diode, first resistor, and second resistor form a voltage divider, and wherein the oscillating power inverter is connected to the series connection of the first and second resistors of the voltage divider; and an output stage coupled to the power inverter for driving a gas discharge lamp load.

2. The circuit of claim 1 wherein said first resistor is connected to said DC voltage source.

3. The circuit of claim 1 further comprising an RF choke connected between said DC voltage source and said oscillating power inverter.

4. The circuit of claim 1 wherein said oscillating power inverter further comprises a transformer having a center tap.

5. The circuit of claim 4 further comprising a first shunt connected between said center tap and a first end of the transformer, and a second shunt connected between the center tap and a second end of the transformer.

6. The circuit of claim 5 wherein said first and second shunts are each comprised of a capacitor.

7. The circuit of claim 6 wherein the capacitance of each of said capacitors have equal values.

8. The circuit of claim 5 wherein said first and second shunts each form a resonant tank with said transformer.

9. The circuit of claim 4 wherein said center tap is coupled to said DC power source.

10. The circuit of claim 9 further comprising an RF choke connected between said center tap and said DC power source.

11. A circuit for driving a gas discharge lamp load comprising:

an input stage for receiving an AC input voltage from an AC voltage source and rectifying the input voltage to create a DC voltage source;

an oscillating power inverter connected to said DC voltage source;

a trigger circuit connected across the DC voltage source and connected to said power inverter to initiate oscillations in said power inverter, wherein said trigger circuit is comprised of a voltage ramp circuit;

said voltage ramp circuit further comprises a zener diode connected in series with first and second resistors with the second resistor being connected in series between the first resistor and the zener diode, wherein the zenor diode, first resistor, and second resistor form a voltage divider, and wherein the oscillating power inverter is connected to the series connection of the first and second resistors of the voltage divider;

an output transformer coupled to said oscillating power inverter for driving a gas discharge lamp load, said output transformer including a tap defining first and second transformer portions; and first and second shunts, said first shunt being coupled in parallel to said first transformer portion, said second shunt being coupled in parallel to said second transformer portion.

12. The circuit of claim 11 wherein said tap is a center tap.

13. The circuit of claim 12 wherein said first and second shunts each comprise a capacitor.

14. The circuit of claim 13 wherein the capacitance of each of said capacitors have equal values.

15. The circuit of claim 11 wherein the first and second shunts have equal impedances.

16. The circuit of claim 11 wherein the first and second shunts each include a capacitor.

17. The circuit of claim 16 wherein the capacitance of each of said capacitors have equal values.

18. The circuit of claim 17 wherein said tap is a center tap.

19. The circuit of claim 11 further comprising an RF choke connected between said tap and said DC voltage source.

20. The circuit of claim 15 further comprising a diode connected between said voltage divider and ground.

* * * * *